US006690165B1

(12) United States Patent
Takahashi

(10) Patent No.: US 6,690,165 B1
(45) Date of Patent: Feb. 10, 2004

(54) MAGNETIC-FIELD SENSING COIL EMBEDDED IN CERAMIC FOR MEASURING AMBIENT MAGNETIC FIELD

(76) Inventor: Hironori Takahashi, 293 Sayre Dr., Princeton, NJ (US) 08540

( * ) Notice: Subject to any disclaimer, the term of this patent is extended or adjusted under 35 U.S.C. 154(b) by 0 days.

(21) Appl. No.: 09/301,064

(22) Filed: Apr. 28, 1999

(51) Int. Cl.[7] ..... H01F 17/06

(52) U.S. Cl. ..... 324/258; 324/247; 336/83

(58) Field of Search ..... 324/258, 257, 324/256, 247, 260, 244, 207.15, 234, 236, 237; 336/83, 200, 225, 232

(56) References Cited

U.S. PATENT DOCUMENTS

| | | | | |
|---|---|---|---|---|
| 3,013,102 A | * | 12/1961 | Doll | 336/84 R |
| 3,189,978 A | | 6/1965 | At | 29/155.5 |
| 3,659,240 A | * | 4/1972 | Learned et al. | 336/200 |
| 3,731,005 A | * | 5/1973 | Shearman | 336/200 |
| 3,812,442 A | * | 5/1974 | Mukelroy | 336/200 |
| 3,852,877 A | | 12/1974 | Ahn et al. | 29/625 |
| 4,020,206 A | | 5/1977 | Beil | 428/137 |
| 4,299,873 A | | 11/1981 | Ogihara et al. | 428/137 |
| 4,346,516 A | | 8/1982 | Yokouchi et al. | 29/845 |
| 4,308,513 A | | 11/1982 | Layton et al. | 336/200 |
| 4,383,235 A | | 5/1983 | Layton et al. | 336/200 |
| 4,642,148 A | | 2/1987 | Kurihara et al. | 156/89 |
| 4,652,825 A | | 3/1987 | Redpath et al. | 324/318 |
| 4,724,283 A | | 2/1988 | Shimada et al. | 174/68.5 |
| 4,861,646 A | | 8/1989 | Barringer et al. | 428/210 |
| 5,151,649 A | * | 9/1992 | Heroux | 324/247 |
| 5,191,699 A | | 3/1993 | Ganslmeier et al. | 29/602.1 |
| 5,337,475 A | | 8/1994 | Aoude et al. | 29/852 |
| 5,384,434 A | | 1/1995 | Mandai et al. | 174/258 |
| 5,534,331 A | | 7/1996 | Aoki et al. | 428/209 |
| 5,597,644 A | | 1/1997 | Araki et al. | 428/210 |
| 5,676,781 A | | 10/1997 | Aoki et al. | 156/89 |

OTHER PUBLICATIONS

M. Drndic et al, Applied Physics Letters, vol. 72, No. 22 pp. 2906–2908 (1998).

* cited by examiner

*Primary Examiner*—Walter E. Snow
(74) *Attorney, Agent, or Firm*—Woodbridge & Associates PC; Richard C. Woodbridge, Esq.; Thomas J. Onka, Esq.

(57) ABSTRACT

A magnetic pick-up coil for measuring magnetic field with high specific sensitivity, optionally with an electrostatic shield (24), having coupling elements (22) with high winding packing ratio, oriented in multiple directions, and embedded in ceramic material for structural support and electrical insulation. Elements of the coil are constructed from green ceramic sheets (200) and metallic ink deposited on surfaces and in via holes of the ceramic sheets. The ceramic sheets and the metallic ink are co-fired to create a monolithic hard ceramic body (20) with metallized traces embedded in, and placed on exterior surfaces of, the hard ceramic body. The compact and rugged coil can be used in a variety of environments, including hostile conditions involving ultra-high vacuum, high temperatures, nuclear and optical radiation, chemical reactions, and physically demanding surroundings, occurring either individually or in combinations.

6 Claims, 7 Drawing Sheets

(7 of 7 Drawing Sheet(s) Filed in Color)

Fig. 2A
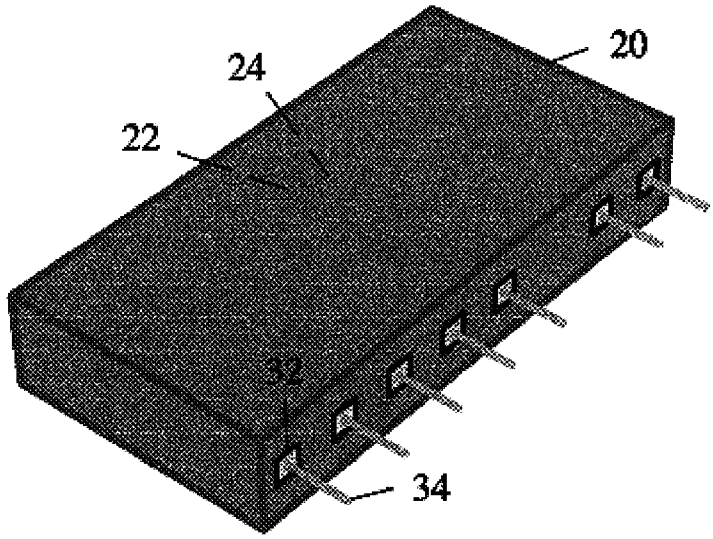
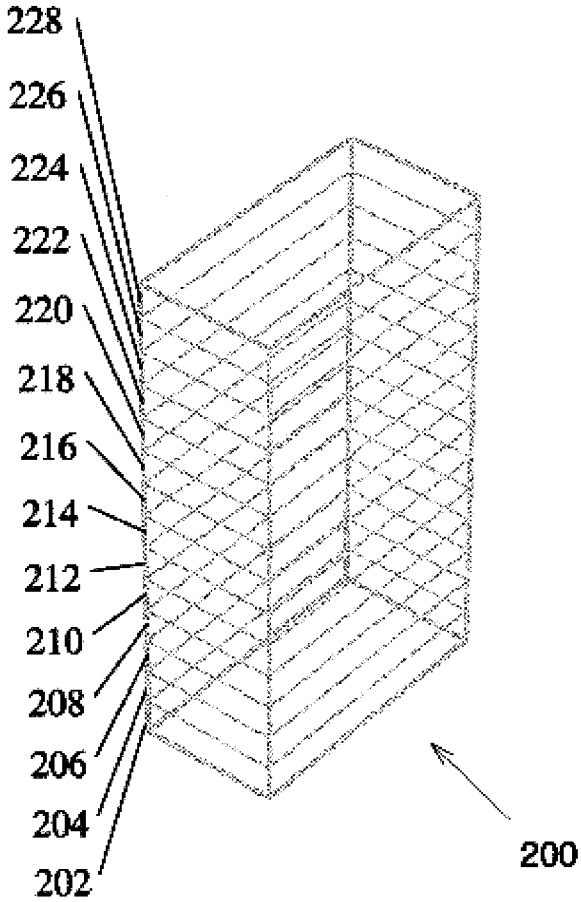
Fig. 2B

Fig. 4A
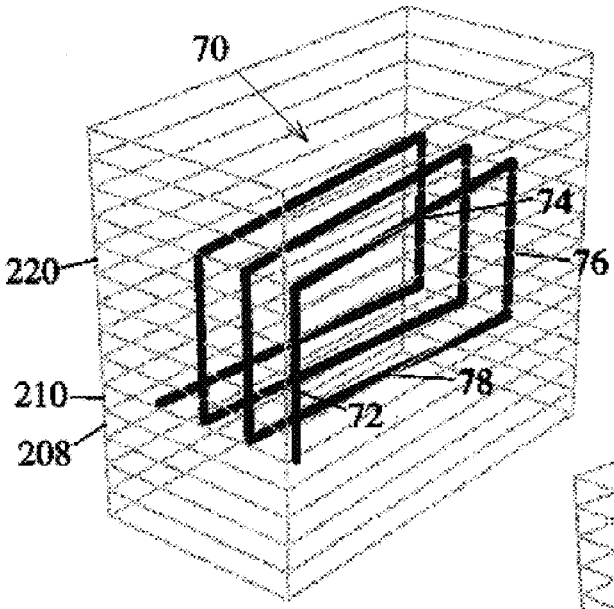
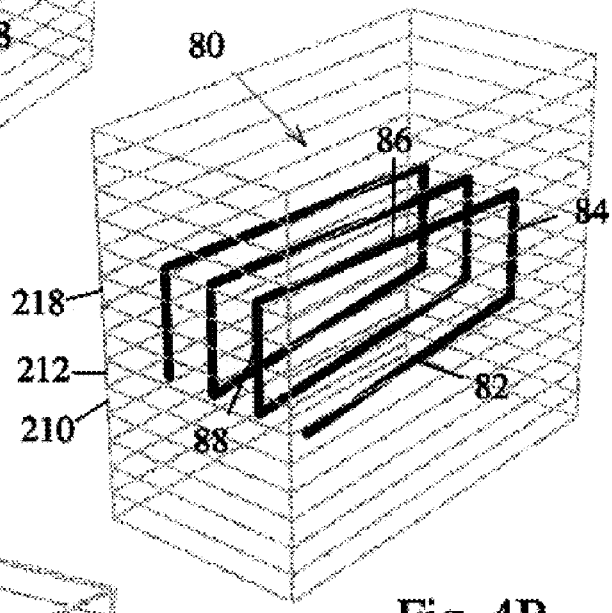
Fig. 4B
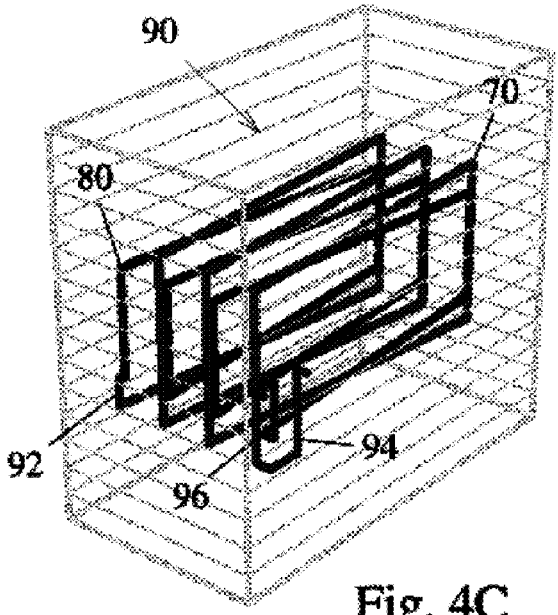
Fig. 4C

Fig. 5A
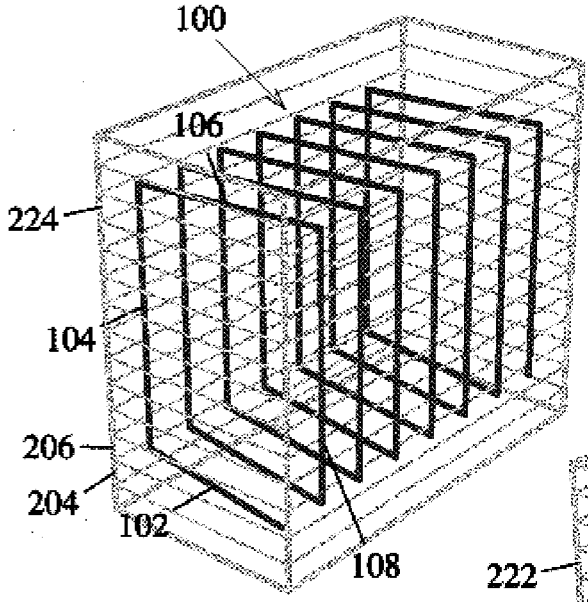
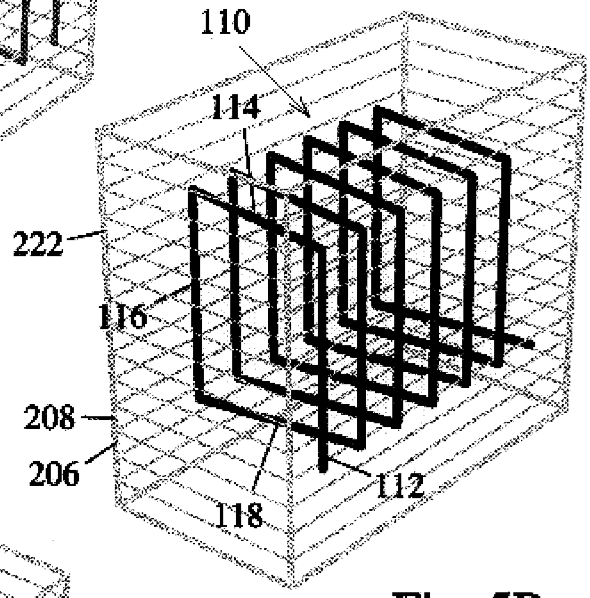
Fig. 5B
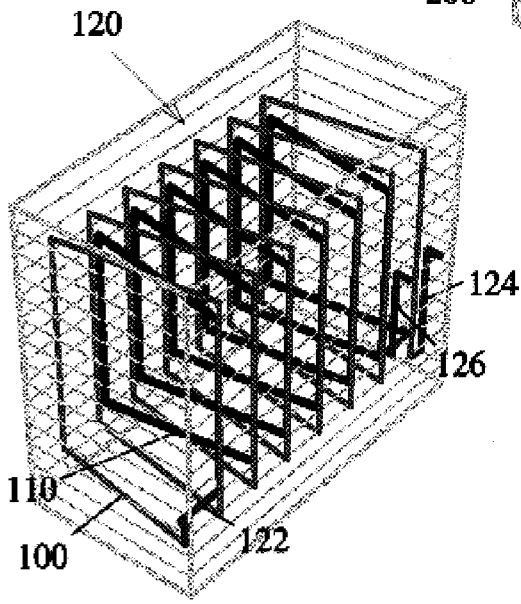
Fig. 5C

Fig. 6A
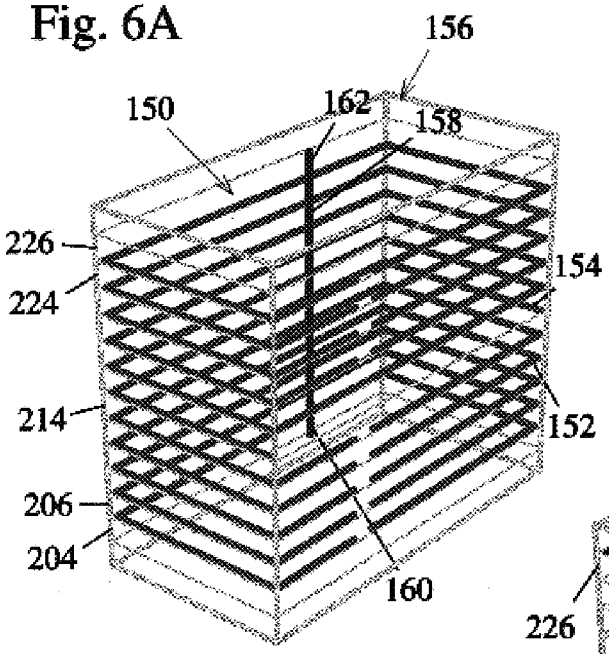
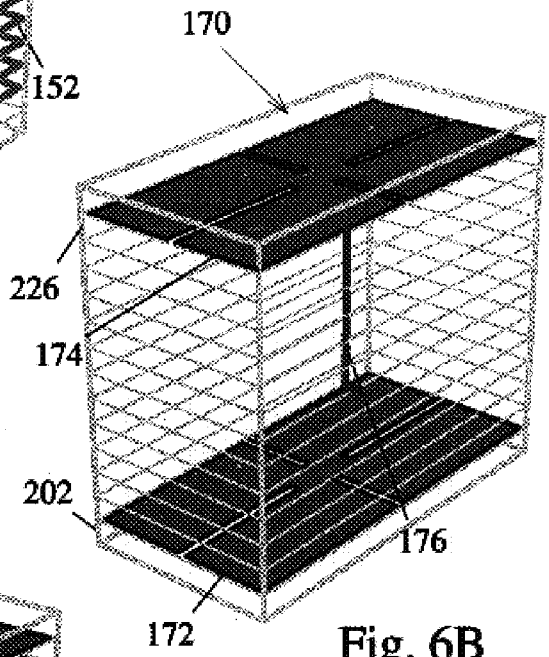
Fig. 6B
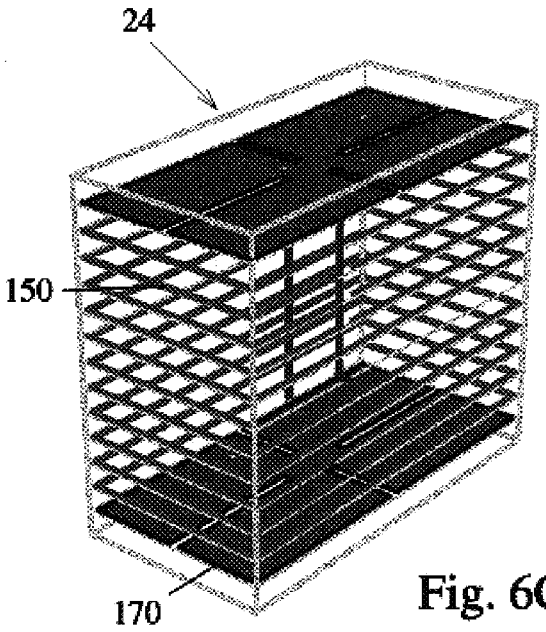
Fig. 6C

MAGNETIC-FIELD SENSING COIL EMBEDDED IN CERAMIC FOR MEASURING AMBIENT MAGNETIC FIELD

FEDERALLY SPONSORED RESEARCH AND DEVELOPMENT

This invention was made with Government support under Contract No. DE-AC02-76CH03073 awarded by the Department of Energy. The Government has certain rights in this invention.

CROSS-REFERENCE TO RELATED APPLICATIONS

Not applicable.

BACKGROUND

1. Field of Invention

This invention relates to magnetic-field pick-up coils for measuring time-varying magnetic field based on the Faraday's law of induction.

2. Description of Prior Art

The need for measuring magnetic field arises in scientific, industrial, and other fields. Magnetic-field sensors commonly employed in these applications use a length of electrically conducting wire formed into a geometrical shape suitable for producing a voltage signal in accordance with the Faraday's law of induction when magnetic field varies with time. Among suitable geometrical shapes the helix is typical of three-dimensional space curves, and the spiral is typical of two-dimensional planar curves. These sensors are often referred to as magnetic-field pick-up coils, or simply magnetic pick-up coils. But the word, coils, is to be understood to mean coupling elements of a general shape rather than just helixes and spirals.

Other devices share structural similarity with the magnetic pick-up coil, but are functionally different on a fundamental level. For example, the inductor is a storage device for magnetic energy. As an electrical circuit element the inductor impedes the flow of electrical current through it by pumping magnetic energy in and out of storage. The magnetic coil is a device that generates magnetic field. The functionality of either device is inseparably tied to magnetic field that is self-generated by electrical current flowing through it. In contrast, the magnetic pick-up coil is a sensing device, and measures ambient magnetic field that originates from sources other than the coil itself.

A magnetic pick-up coil having elements essential for fulfilling its central functionality is illustrated in a perspective view in FIG. 1A. This basic coil has two helixes shown in green and blue, an inter-helix connection shown in black, and two connecting leads shown in red. The black arrow indicates the direction of magnetic field coupled by the coil. These elements are electrically and mechanically joined in series as indicated in the figure. The smaller green helix nests inside the volume enclosed by the larger blue helix, forming two layers of winding, each with multiple winding turns. The two helixes are wound in the same sense so that voltage generated in either helix adds cooperatively to voltage generated in the other, and resultant voltage appears between the two connecting leads. All elements are made from electrically conducting bare wire that is not electrically insulated, and that is stiff enough to hold its own shape without structural support. Magnetic pick-up coils in practical use are variations of the basic coil modified to improve its performance in some ways.

A measure of performance of a magnetic pick-up coil is its sensitivity, or voltage generated for a unit rate of change of coupled magnetic field, which is often expressed in terms of effective coupling area. Another performance measure of a coil is its sensitivity in relation to its physical size, which may be called specific sensitivity.

The basic magnetic pick-up coil of FIG. 1A has poor specific sensitivity for two fundamental reasons. First, winding must use thick wire to hold its geometrical shape. Second, winding layers must be placed wide apart, and winding turns in each layer must be separated from each other in order to keep winding layers and turns from short-circuiting.

A magnetic pick-up coil of a conventional construction in wide practical use is illustrated in a cross-sectional view in FIG. 1B. The coil is made from thin electrically insulated wire and an electrically insulated former. The cross section of a hollow cylindrical former is shown in dark green, and the cross sections of wire are shown as filled circles in pink. A black circle around each wire cross section represents electrically insulating coating. The diameter of the thin wire is greatly exaggerated in this figure for clarity of presentation. The wire is not stiff enough to hold a geometrical shape on its own. Structural support for layers and turns is provide by winding an innermost layer on, and in contact with, the former, and winding each of outer layers over, and in contact with, a layer just underneath. Turns in a layer are also placed close together, and may be in contact with neighboring turns. Electrical isolation between layers and turns is provided by the wire's insulating coating in this construction. A magnetic pick-up coil must use material for structural support and electrical insulation that is compatible with an environment in which the coil is used.

Magnetic pick-up coils presently in use suffer a number of shortcomings in scientific applications. They are primarily associated with satisfying simultaneous demands for good specific sensitivity and compatibility with a hostile environment present in a scientific facility.

In a plasma fusion reactor, for example, protective first walls inside an ultra-high-vacuum vessel are expected to become extremely hot under massive heat influx from the plasma. Temperatures of their plasma-facing surfaces are expected to reach as high as 1300° C. Magnetic pick-up coils will be placed in extremely limited space behind protective first walls, and must be compatible simultaneously with ultra-high vacuum and extremely high temperatures. These coils will also receive intense nuclear radiation from the plasma. Few designs, if any, exist today for magnetic pick-up coils that can meet these demands. In many other scientific applications, simultaneous needs for ultra-high vacuum and high temperatures are frequently encountered, because the vacuum vessel must be baked at high temperatures, often in excess of 350° C., to achieve ultra-high vacuum.

Polyimide and PTFE are commonly used for insulating wire as well as for making a former and other support structures in a magnetic pick-up coil. These versatile insulators are suitable for use in a normal environment. But they are unfit for use in ultra-high vacuum because of excessive out-gassing. They cannot be used at high temperatures because they melt. In a combined ultra-high-vacuum and high-temperature environment, vacuum and temperature ranges accessible to them are more severely limited, because out-gassing increases rapidly at elevated temperatures. Polyimide- and PTFE-based magnetic pick-up coils are usually not used at temperatures much above 200° C. in ultra-high-vacuum applications. These coils are also susceptible to damage by nuclear radiation. Some hostile environments encountered in industrial applications also make these coils unfit for use. For example, some chemical reactions, heat, abrasion, and nuclear and optical radiation may degrade or destroy their support structure and electrical insulation.

Effort to surmount some of the problems encountered in a hostile environment led to the use of different material and constructions for structural support and electrical insulation. But achieving good specific sensitivity at the same time remains an elusive goal.

Mineral-Insulated cable, or MI cable, is sometimes used for building a magnetic pick-up coil. But the thick cable adds appreciably to the overall coil size, and reduces specific sensitivity. MI cable cannot be bent in small radius, and limits design options. MI cable itself is expensive to manufacture. Coils made of MI cable are also expensive to build, because handling of MI cable is difficult. Wire is also used that is coated with ceramic for insulation, but has shortcomings similar to those of MI cable.

Structural support and electrical insulation are sometimes provided for thin bare wire by inserting a sleeve of an insulating material, typically ceramic, between adjacent winding layers, and placing winding turns in each layer in a helical groove cut into the sleeve. But winding turns in such constructions are wide apart, and sleeves add greatly to the overall coil size. Specific sensitivity is poor. It is technically difficult and economically costly to make a large number of nested ceramic sleeves mechanically stable. Coils made of ceramic sleeves are fragile, and expensive to manufacture.

Metallic film of a spiral or other suitable planar shape may be laid on the surface of a hard ceramic plate using etching and other techniques to make a single-layer magnetic pick-up coil. A multitude of these planar coils in two dimensions may be assembled in a stack, one on top of another, in an effort to build up in a third dimension perpendicular to the plate face, and make a single multi-layer coil with high specific sensitivity. But no convenient and secure ways exist for electrically and mechanically connecting the single-layer coils.

Shortcomings of magnetic pick-up coils of a conventional construction can arise also from other demands made on the coil: for example, the need for simultaneous measurement in multiple directions and electrostatic shielding.

Needs arise often in scientific applications to measure magnetic field in more than one direction about a single point in space. They can be met with a multi-axis coil constructed from nested multiple single-axis coils oriented in multiple directions. But when each of these single-axis coils must be built to be compatible with a hostile environment, with appropriate material and construction for structural support and electrical insulation, the resultant multi-axis coil will be large, and specific sensitivity will be poor.

Electrostatic shielding is often required in a magnetic pick-up coil used in scientific applications, because measurement is conducted in an electrostatically noisy environment. An electrostatic shield is an electrically conducting structure enclosing a magnetic-field coupling element, and shields out undesired noise coming from electrostatic sources by creating a surface of equal electrostatic potential around the coupling element. But an electrostatic shield allows, at the same time, desired time-varying magnetic field to reach the coupling element by eliminating or reducing eddy currents in the shield driven by the field. An electrostatic shield of a conventional construction needs its own structural support and electrical insulation, adds appreciably to the physical size of a magnetic pick-up coil, and reduces its specific sensitivity.

Further shortcomings of a magnetic pick-up coil of a conventional construction are associated with economical manufacturing, testing, and marketing.

Magnetic pick-up coils of a conventional construction are usually not amenable to mass production, and cannot take advantage of the economy of scale in manufacturing. They are fabricated one at a time, and resultant variations in their characteristics necessitate testing and calibration of individual pieces, further adding to production cost. Various limitations described in the above paragraphs make it difficult to let coils of a single design serve in a variety of environments. Coils of many different designs must be prepared for different applications, and increase their marketing cost.

SUMMARY

In accordance with the present invention a magnetic pick-up coil comprises magnetic-field coupling elements embedded in a body of ceramic material for structural support and electrical insulation. An electrostatic shielding element may optionally be embedded in the same ceramic body.

Objects and Advantages

Accordingly, several objects and advantages of the present invention are:

1 to provide a magnetic pick-up coil that is suitable for use in a wide variety of environments;

2 to provide a magnetic pick-up coil that is suitable for use in hostile environments;

3 to provide a magnetic pick-up coil that has high specific sensitivity;

4 to provide a magnetic pick-up coil that is compact and rugged;

5 to provide a magnetic pick-up coil that can effectively use space curves in three dimensions as geometry of its coupling elements;

6 to provide a magnetic pick-up coil that can measure in more than one direction about a single point in space; and 7 to provide a magnetic pick-up coil that is amenable to mass production.

The foregoing and other objects, features, aspects and advantages of the present invention will become more apparent from the following detailed description of the present invention when taken in conjunction with the accompanying drawings.

DRAWING FIGURES

The patent or application file contains at least one drawing executed in color. Copies of this patent or patent application publication with color drawing(s) will be provided by the office upon request and payment of the necessary fee.

In the drawings, closely related figures have the same number but with different alphabetic suffixes.

FIG. 2A shows an overall exterior view of a magnetic pick-up coil of the present invention.

FIG. 2B shows a method of indicating green ceramic sheets inside the ceramic body of a magnetic pick-up coil.

FIGS. 4A to 4C show construction of a x-helix coupling element.

FIGS. 5A to 5C show construction of a y-helix coupling element.

FIGS. 6A to 6C show construction of an electrostatic shielding element.

Figure 1A:
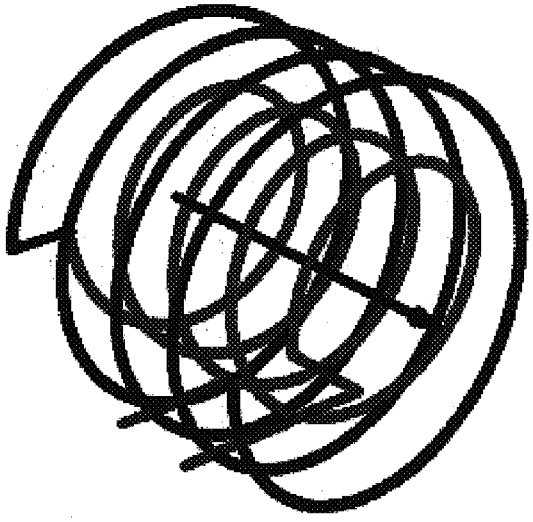
Fig. 1A Prior Art
FIGS. 1A and 1B show prior art.
Figure 1B:
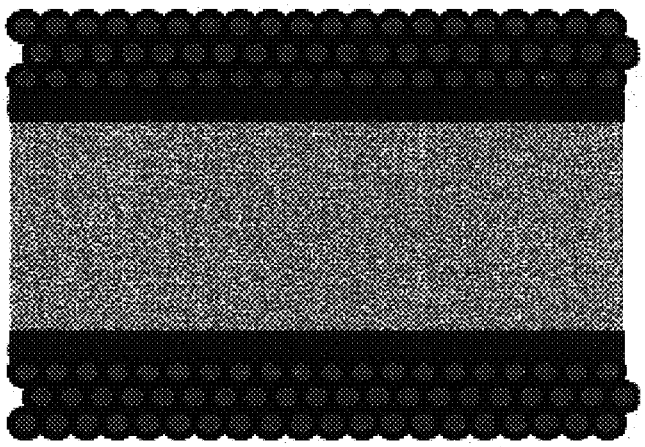
Fig. 1B Prior Art

REFERENCE NUMERALS IN DRAWINGS 20 monolithic ceramic body
22 coupling elements
24 shielding element
32 metallized pads
34 terminal pins
40 z-spiral coupling element
42 lower z-spiral trace
44 upper z-spiral trace
46 inter-z-spiral connecting trace
48 part of inter-z-spiral connecting trace
50 part of inter-z-spiral connecting trace
52 lower z-spiral lead trace
54 part of lower z-spiral lead trace
56 part of lower z-spiral lead trace
58 part of lower z-spiral lead trace
60 upper z-spiral lead trace
62 part of upper z-spiral lead trace
64 part of upper z-spiral lead trace
66 part of upper z-spiral lead trace
70 outer x-helix trace
72 near-side vertical trace of a turn of outer x-helix trace
74 upper horizontal trace of a turn of outer x-helix trace
76 far-side vertical trace of a turn of outer x-helix trace
78 lower horizontal trace of a turn of outer x-helix trace
80 inner x-helix trace
82 lower horizontal trace of a turn of inner x-helix trace
84 far-side vertical trace of a turn of inner x-helix trace
86 upper horizontal trace of a turn of inner x-helix trace
88 near-side vertical trace of a turn of inner x-helix trace
90 x-helix coupling element
92 inter-x-helix connecting trace
94 outer x-helix lead trace
96 inner x-helix lead trace
100 outer y-helix trace
102 lower horizontal trace of a turn of outer y-helix trace
104 far-side vertical trace of a turn of outer y-helix trace
106 upper horizontal trace of a turn of outer y-helix trace
108 near-side vertical trace of a turn of outer y-helix trace
110 inner y-helix trace
112 near-side vertical trace of a turn of inner y-helix trace
114 upper horizontal trace of a turn of inner y-helix trace
116 far-side vertical trace of a turn of inner y-helix trace
118 lower horizontal trace of a turn of inner y-helix trace
120 y-helix coupling element
122 inter-y-helix connecting trace
124 outer y-helix lead trace
126 inner y-helix lead trace
150 shielding-edge trace set
152 shielding-edge traces with a small opening
154 shielding-edge trace with a large opening
156 shielding inter-connecting trace
158 main inter-connecting trace
160 lower inter-connecting extension trace
162 upper inter-connecting extension trace
170 shielding-strip trace set
172 lower shielding-strip trace
174 upper shielding-strip trace
176 shielding lead trace
200 green ceramic sheet stack
202 first green ceramic sheet -continued 204 second green ceramic sheet
206 third green ceramic sheet
208 fourth green ceramic sheet
210 fifth green ceramic sheet
212 sixth green ceramic sheet
214 seventh green ceramic sheet
216 eighth green ceramic sheet
218 ninth green ceramic sheet
220 tenth green ceramic sheet
222 eleventh green ceramic sheet
224 twelfth green ceramic sheet
226 thirteenth green ceramic sheet
228 fourteenth green ceramic sheet

DESCRIPTION

Fabrication Method

A novel concept underlying the present invention is to build a magnetic pick-up coil by embedding some or all of its elements within a monolithic body of ceramic. Take, for example, the basic coil of FIG. 1A, and embed it within ceramic material. In a coil of such construction, ceramic material will provide structural support and electrical insulation, allow high winding packing ratio, and yield high specific sensitivity. Necessary technology is standard and well known, and is described, for example, in U.S. Pat. No. 3,189,978 to Stetson (1965).

The fabricating process begins with the green ceramic sheet, or a clay-like compound pressed into a pliant sheet comprising ceramic material dispersed in a heat volatile binder, and metallic ink, or a paste-like compound comprising metallic powder dispersed in a heat volatile binder. Metallic ink is deposited in the form of film to create patterns on usually the top surface, but sometimes the bottom surface, of a ceramic sheet using screening and other techniques. Patterns drawn with metallic ink on a surface of a ceramic sheet are usually made up from lines, but also areas in some cases. Holes, commonly known as via holes, may also be punched through a ceramic sheet, and filled with metallic ink using vacuum suction and other techniques.

A multitude of green ceramic sheets, prepared with metallic ink on their surfaces and in their via holes, are then assembled in a stack, one on top of another, under pressure. Patterns of metallic ink may also be applied on exterior surfaces of the stack. A via hole in a ceramic sheet filled with metallic ink serves as connection between a metallic ink pattern on the top surface of that sheet and a metallic ink pattern on the bottom surface of the same sheet, or on the top surface of another sheet just underneath. A series of via holes, placed at a corresponding location on each of a set of adjacent sheets, will produce a vertically running line of metallic ink through the set. A slanted or curved vertical line of metallic ink can be emulated by staggering via holes by a small distance between two neighboring sheets. Three-dimensional patterns are now constructed, within a space occupied by the stack, from planar patterns on horizontal surfaces and vertical lines in via holes. These three-dimensional patterns will become building blocks of coupling, shielding, and other elements of a magnetic pick-up coil of the present invention.

The stack of green ceramic sheets and metallic ink patterns are now fired together, or co-fired, in furnace at high temperatures. Co-firing sinters ceramic material in green ceramic sheets, and turns it into dense hard ceramic. Ceramic sheets lose their individual identity, and merge into a substantially monolithic body. Co-firing also turns metallic ink patterns in the stack interior into hard electrically-conducting metallized traces embedded within the ceramic body, and metallic ink patterns on stack exterior surfaces into electrically-conducting metallized traces on exterior surfaces of the ceramic body. Exterior metallized traces may serve as pads for electrical connection. Metal joining techniques, such as brazing and soldering, can attach metallic terminal pins to metallized pads. Exterior metallized traces may also serve as parts of an electrostatic shield.

In the remainder of this description, processes of depositing metallic ink on green ceramic sheets and co-firing ink patterns and ceramic sheets are to be implicitly understood as necessary steps leading to creation of metallized traces in a monolithic ceramic body. For example, a statement, "a metallized trace is laid on the surface of a certain ceramic sheet," implies a series of steps needed to embed a metallized trace in a particular position within the ceramic body that corresponds to the position of the surface of that ceramic sheet before co-firing. Shrinkage of ceramic sheets upon co-firing must be taken into account in this positional correspondence.

Choice of Technology and Material

The method described above is generally known as the thick-film technology. Its ability to create embedded metallized traces holds an important advantage in constructing a coupling element out of a space curve in three dimensions.

In the thick-film technology the melting point of metal in the metallic ink must be higher than the sintering temperature of ceramic material in the green ceramic sheet. The sintering temperature in turn sets the upper limit of usable temperature range of a device. Different combinations of metal and ceramic material can be used. But the use of a refractory metal, which has a high melting point, together with ceramic material having a correspondingly high sintering temperature, extends the usable temperature range of a device. Low conductivity of metallized traces made from a refractory metal is of no great consequence for a sensing device such as a magnetic pick-up coil, because little electrical current needs to flow through it.

Its extremely high-temperature capability notwithstanding, a magnetic pick-up coil of the present invention can also be used in a normal environment.

Model Coil for Drawings

A simple model coil will be depicted in drawings, as elements of a practical coil of the present invention are too complex for illustrating its structure. The model device has all qualitative features of a practical device, but has generally fewer winding layers, and fewer turns in each layer than a practical device.

In a typical embodiment, a magnetic pick-up coil of the present invention may be imagined basically as a piece of ceramic, rectangular in shape, several millimeters in the smallest dimension, and several centimeters in the largest dimension. But, more generally, the size and shape of a magnetic pick-up coil of the present invention varies widely. The ceramic piece may contain just one element for coupling to magnetic field, or multiple elements, usually arranged to couple magnetic field in different directions. Coupling elements are embedded in most part within the ceramic piece, and are not visible from outside, except their ends that are exposed on exterior surfaces of the ceramic piece. Some connecting elements, such as metallized pads on exterior surfaces of the ceramic piece and terminal pins made of metals and attached to the pads, are used for electrically connecting ends of a coupling element to an external device. An electrostatic shielding element may surround coupling elements.

Embedded coupling and shielding elements are hidden within a monolithic ceramic body, and will be depicted in a perspective view, pretending as if ceramic material were transparent. Individual green ceramic sheets are no longer recognizable in a finished monolithic ceramic body. But depicting relationships between original individual sheets and hidden internal elements will aid understanding of the device's structure. Ceramic sheets will be shown in drawings by their outlines, but in a greatly exaggerated length scale in a direction perpendicular to the plane of sheets, as they are typically only a fraction of millimeter thick in a practical construction. The outlines of sheets will serve also as an indicator of relative scale expansion among different drawings.

Exterior View of Preferred Embodiment—FIG. 2A and FIG. 2B

A preferred embodiment of a magnetic pick-up coil of the present invention is illustrated in FIG. 2A, which measures magnetic field in three orthogonal directions. The embodiment has a monolithic ceramic body 20, a set 22 of three coupling elements, a shielding element 24, seven metallized pads 32, and seven terminal pins 34. Terminal pins are made of metals, often alloys. Only a representative pair of a metallized pad and a terminal pin is shown with reference numerals 32 and 34, respectively. Coupling element set 22 and shielding element 24 are embedded within ceramic body 20, and are not visible. Their shapes are too complex to be indicated in this drawing, and will be discussed later in this description. Each end of each coupling element of set 22 is exposed on a surface of ceramic body 20, and is electrically connected to distinct metallized pad 32. Part of shielding element 24 is also exposed on the same surface of ceramic body 20, and is electrically connected to distinct metallized pad 32. Metallized pad 32 is connected electrically and mechanically to terminal pin 34, using a metal joining technique such as brazing. Metallized pad 32 and terminal pin 34 are gold-plated. Specifying which combinations of metallized pads and terminal pins are for coupling elements or shielding element is not crucial for the purpose of understanding salient structural features of the present invention.

Those metallized pads and terminal pins that are connected to coupling elements of set 22 constitute collectively a particular type of coupling-element connecting means employed in this embodiment. The metallized pad and terminal pin that are connected to shielding element 24 constitute collectively a particular type of shielding-element connecting means employed in this embodiment. Other types of connecting means may be employed and placed on a different surface, or multiple surfaces, of a monolithic ceramic body in other embodiments. Types and layout of connecting means are not crucial in understanding salient features of the invention's internal structure. In the remainder of this description, connecting means will be omitted from drawings and discussion for simplicity.

Adopting a right-handed Cartesian coordinate system will aid explanation of the device's structure. The origin of the coordinate system is at the geometrical center of monolithic ceramic body 20. The z-axis is pointing upward and perpendicular to the top or bottom surface of the ceramic body, the x-axis is along a shorter side of the ceramic body, and the y-axis is along a longer side of the ceramic body. The device of FIG. 2A is shown in another form in FIG. 2B wherein the length scale in a z-direction is greatly exaggerated, outlines of ceramic sheets are shown, but hidden internal elements are still omitted. A stack of ceramic sheets 200 comprises fourteen sheets, from a first sheet 202 at the bottom, a second sheet 204 above it, and so forth, through a fourteenth sheet 228 at the top.

Figure 3:
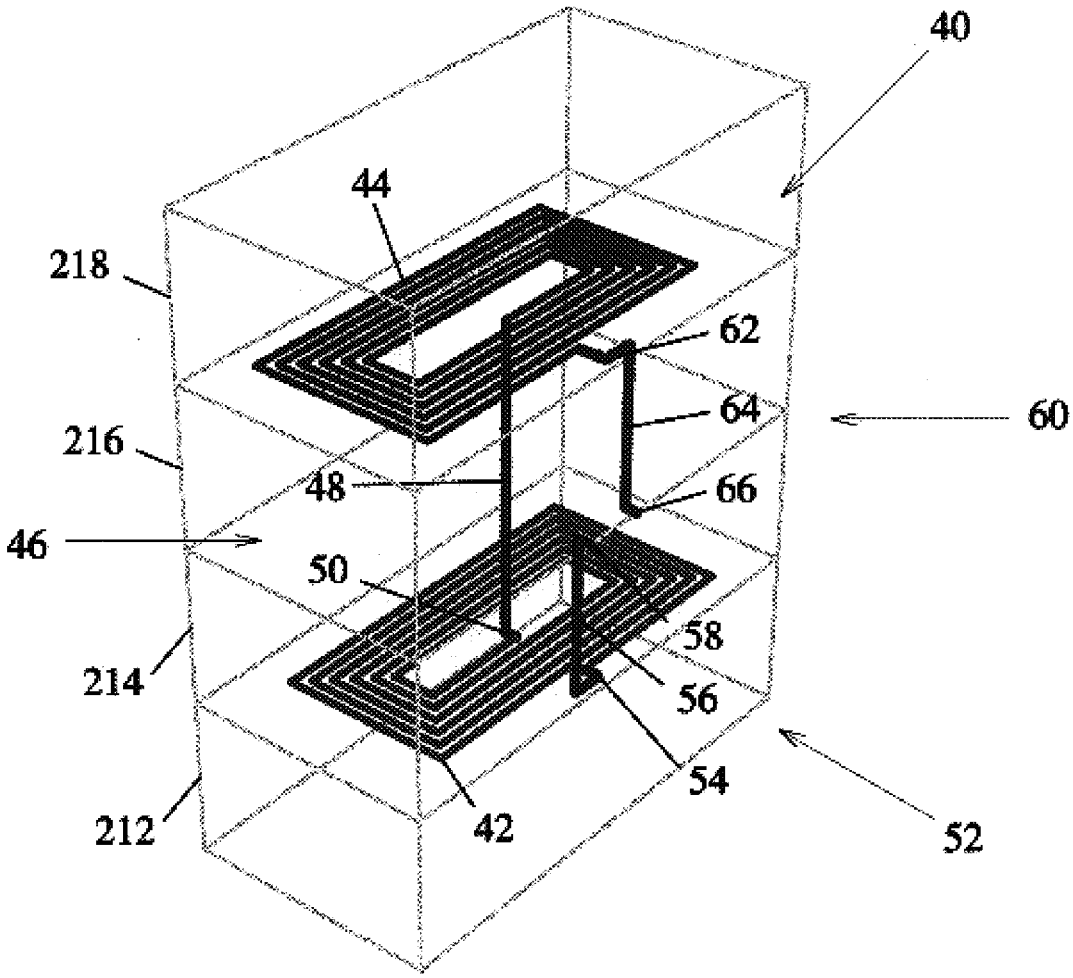
FIG. 3 shows construction of a z-spiral coupling element.

Coupling Element in Z-direction—FIG. 3

A coil element for coupling to magnetic field in a z-direction in this embodiment substantially comprises a pair of spirals, one stacked on top of the other, with their axes oriented along the z-axis of the coordinate system. This coupling element will be referred to as a z-spiral coupling element.

A z-spiral coupling element 40 is shown in FIG. 3. Only central four sheets of the stack are visible in this view: sixth sheet 212, seventh sheet 214, eighth sheet 216, and ninth sheet 218 are shown. A lower z-spiral trace 42 is laid on the top surface of sixth ceramic sheet 212. An upper z-spiral trace 44 is laid on the top surface of eighth ceramic sheet 216. The z-spiral traces are placed at an equal distance away on either side of the midplane of the ceramic sheet stack by the presence of seventh sheet 214 acting as a spacer. A volume in space over which the z-spiral coupling element will measure magnetic field is thus centered substantially about the center of the ceramic body. Ninth sheet 218 is shown simply for the purpose of maintaining symmetry in the figure. These z-spiral traces are wound in the same sense so that voltage generated in either spiral trace adds cooperatively to voltage generated in the other spiral trace when coupled magnetic field varies with time.

An inter-z-spiral connecting trace 46 comprises a trace 48 laid in via holes through seventh sheet 214 and eighth sheet 216, and a short trace 50 laid on the top surface of sixth sheet 212. A lower z-spiral lead trace 52 comprises a trace 54 laid on the top surface of sixth ceramic sheet 212, a trace 56 laid in a via hole through seventh ceramic sheet 214, and a trace 58 laid on the top surface of seventh ceramic sheet 214. An upper z-spiral lead trace 60 comprises a trace 62 laid on the top surface of eighth sheet 216, a trace 64 laid in a via hole through eighth sheet 216, and a trace 66 laid on the top surface of seventh sheet 214. Lower z-spiral-lead trace 52, lower z-spiral trace 42, inter-z-spiral connecting trace 46, upper z-spiral trace 44, and upper z-spiral lead trace 60 are connected in series, and together form z-spiral coupling element 40.

This model pick-up coil employs only a pair of z-spiral traces. But a practical device may utilize any number of pairs of z-spiral traces, each pair stacked on top of the next, and connected in series by replacing one of lead traces by an inter-spiral connecting trace in order to increase coupling to magnetic field.

A free end of part 58 of lower z-spiral lead trace 52 and a free end of part 66 of upper z-spiral lead trace 60 are at two neighboring locations at an edge of seventh ceramic sheet 214. These are also two ends of z-spiral coupling element 40. Before co-firing, these ends will be visible, sandwiched between seventh sheet 214 and eighth sheet 216, on an exterior surface of the ceramic sheet stack. After co-firing, these ends will become metallized traces that are exposed on a face of the monolithic ceramic body. The exposed metallized traces will serve as connecting points, and will be electrically connected to metallized pads of the z-spiral coupling element.

Layout of lead traces and inter-connecting traces is to be chosen with considerations given, among other issues, to minimizing unwanted stray coupling to magnetic field in directions other than an intended direction. Beyond such general considerations, actual layout of these traces is not crucial in understanding salient features of the invention's structure. The remainder of this description will therefore omit detailed specifications of layout of lead traces and inter-connecting traces.

Coupling Element in X-direction—
FIGS. 4A, 4B, and 4C

A coil element for coupling to magnetic field in a x-direction in this embodiment primarily comprises a pair of helixes, one nested within the other, with their axes oriented along the x-axis of the coordinate system. This coupling element will be referred to as a x-helix coupling element.

An outer x-helix trace 70 is shown in FIG. 4A. All fourteen ceramic sheets are shown in this view and all other views that follow. The helical trace is laid on the top surfaces of fourth ceramic sheet 208 and tenth ceramic sheet 220, and in via holes in a set of six ceramic sheets, comprising fifth sheet 210, tenth sheet 220, and all sheets in between. Outer x-helix trace 70 comprises three turns of trace connected in series and displaced by an outer x-helix pitch. A typical turn of trace comprises a near-side vertical trace 72, an upper horizontal trace 74, a far-side vertical trace 76, and a lower horizontal trace 78. Near-side vertical trace 72 is constructed by placing a via hole at a corresponding location in each of the set of six ceramic sheets so that traces in these via holes form a contiguous vertical run. Far-side vertical trace 76 is constructed similarly. Upper horizontal trace 74 and lower horizontal trace 78 are laid on the top surfaces of fourth ceramic sheet 208 and tenth ceramic sheet 220, respectively. Remaining turns are constructed similarly.

An inner x-helix trace 80 is shown in FIG. 4B. The helical trace is laid on the top surfaces of fifth ceramic sheet 210 and ninth ceramic sheet 218, and in via holes in a set of four ceramic sheets, comprising sixth sheet 212, ninth sheet 218, and all sheets in between. Inner x-helix trace 80 comprises three turns of trace connected in series and displaced by an inner x-helix pitch. A typical turn of trace comprises a lower horizontal trace 82, a far-side vertical trace 84, an upper horizontal trace 86, and a near-side vertical trace 88. Far-side vertical trace 84 is constructed by placing a via hole at a corresponding location in each of the set of four ceramic sheets so that traces in these via holes form a contiguous vertical run. Near-side vertical trace 88 is constructed similarly. Lower horizontal trace 82 and upper horizontal trace 86 are laid on the top surfaces of fifth ceramic sheet 210 and ninth ceramic sheet 218, respectively. Remaining turns are constructed similarly.

A x-helix coupling element 90 shown in FIG. 4C comprises outer x-helix trace 70, inner x-helix trace 80, an inter-x-helix connecting trace 92, an outer x-helix-lead trace 94, and an inner x-helix-lead trace 96. Inner x-helix 80 is constructed smaller in dimension than outer x-helix 70 in both y- and z-directions in such a way that inner x-helix trace 80 nests inside the volume enclosed by outer x-helix trace 70. The two x-helix traces are wound in the same sense so that voltage generated in either helical trace adds cooperatively to voltage generated in the other helical trace when coupled magnetic field varies with time. These x-helix traces are positioned substantially centered about the center of the ceramic body. A volume in space over which the x-helix coupling element will measure magnetic field is thus centered substantially about the center of the ceramic body.

This model pick-up coil employs only a pair of x-helix traces. But a practical device may utilize any number of pairs of x-helix traces, each pair nested within the next, and connected in series by replacing one of lead traces by an inter-helix connecting trace in order to increase coupling to magnetic field.

Coupling Element in Y-direction—
FIGS. 5A, 5B, and 5C

A coil element for coupling to magnetic field in a y-direction in this embodiment primarily comprises a pair of helixes, one nested within the other, with their axes oriented along the y-axis of the coordinate system. This coupling element will be referred to as a y-helix coupling element.

An outer y-helix trace 100 is shown in FIG. 5A. The helical trace is laid on the top surfaces of a second ceramic sheet 204 and a twelfth ceramic sheet 224, and in via holes through a set of ten ceramic sheets, comprising a third sheet 206, twelfth sheet 224, and all sheets in between. The helical trace comprises seven turns of trace connected in series and displaced by an outer y-helix pitch. A typical turn of trace comprises a lower horizontal trace 102, a far-side vertical trace 104, an upper horizontal trace 106, and a near-side vertical trace 108. Far-side vertical trace 104 is constructed by placing a via hole at a corresponding location in each of the set of ten ceramic sheets so that traces in these via holes form a contiguous vertical run. Near-side vertical trace 108 is constructed similarly. Lower horizontal trace 102 and upper horizontal trace 106 are laid on the top surfaces of second ceramic sheet 204 and twelfth ceramic sheet 224, respectively. Remaining turns are constructed similarly.

An inner y-helix trace 110 is shown in FIG. 5B. The helical trace is laid on the top surfaces of a third ceramic sheet 206 and an eleventh ceramic sheet 222, and in via holes through a set of eight ceramic sheets, comprising fourth sheet 208, eleventh sheet 222, and all sheets in between. The helical trace comprises six turns of trace connected in series and displaced by an inner y-helix pitch. A typical turn of trace comprises a near-side vertical trace 112, an upper horizontal trace 114, a far-side vertical trace 116, and a lower horizontal trace 118. Near-side vertical trace 112 is constructed by placing a via hole at a corresponding location in each of the set of eight ceramic sheets so that traces in these via holes form a contiguous vertical run. Far-side vertical trace 116 is constructed similarly. Upper horizontal trace 114 and lower horizontal trace 118 are laid on the top surfaces of third ceramic sheet 206 and eleventh ceramic sheet 222, respectively. Remaining turns are constructed similarly.

A y-helix coupling element 120 shown in FIG. 5C comprises outer y-helix trace 100, inner y-helix trace 110, an inter-y-helix connection trace 122, an outer y-helix-lead trace 124, and an inner y-helix-lead trace 126. Inner y-helix 110 is constructed smaller in dimension than outer y-helix 100 in both x- and z-directions in such a way that inner y-helix trace 110 nests inside the volume enclosed by outer y-helix trace 100. The two y-helix traces are wound in the same sense so that voltage generated in either helical trace adds cooperatively to voltage generated in the other helical trace when coupled magnetic field varies with time. These y-helix traces are positioned substantially centered about the center of the ceramic body. A volume in space over which the y-helix coupling element will measure magnetic field is thus centered substantially about the center of the ceramic body.

This model pick-up coil employs only a pair of y-helix traces. But a practical device may utilize any number of pairs of y-helix traces, each pair nested within the next, and connected in series by replacing one of lead traces by an inter-helix connecting trace in order to increase coupling to magnetic field.

Electrostatic Shielding Element—
FIGS. 6A, 6B, and 6C

An electrostatic shielding element in this embodiment is a cage-like structure made of metallized traces that surrounds the coupling elements. The electrostatic shielding element substantially comprises shielding-edge traces and shielding-strip traces. Each shielding-edge trace is a line trace that circumnavigates the periphery of a ceramic sheet. It does not close onto itself, however, and leaves an opening on a side of the ceramic sheet. Each shielding-strip trace is an area trace that substantially covers the top surface of a ceramic sheet, but has slits cut into it. Both an opening in a shielding-edge trace and slits in a shielding-strip trace eliminate or reduce eddy currents driven in the shield by time-varying magnetic field.

A shielding-edge trace set 150 is shown in FIG. 6A. It comprises shielding-edge traces and a shielding inter-connecting trace.

A shielding-edge trace with a small opening 152 is laid on the top surface of each of a set of ten ceramic sheets, comprising second sheet 204, twelfth sheet 224, and all sheets in between with an exception of seventh sheet 214. Only one representative shielding-edge trace with a small opening is indicated by reference numeral 152. A shielding-edge trace with a large opening 154 is laid on the top surface of seventh ceramic sheet 214. An opening, small or large, in a shielding-edge trace prevents eddy currents from flowing around it. The large opening in shielding-edge trace 154 also lets coupling-element and shielding-element lead traces to pass from an interior volume to a surface of the ceramic body.

A shielding inter-connecting trace 156 is constructed by placing a via hole at a corresponding location in each of a set of twelve ceramic sheets, comprising second sheet 204, thirteenth sheet 226, and all sheets in between, so that traces in these via holes form a contiguous vertical run. Shielding inter-connecting trace 156 comprises a main inter-connecting trace 158, a lower inter-connecting extension trace 160, and an upper inter-connecting extension trace 162. Main inter-connecting trace 158 is a central portion of shielding inter-connecting trace 156 in via holes through a set of ten ceramic sheets, comprising third ceramic sheet 206, twelfth ceramic sheet 224, and all sheets in between. Lower inter-connecting extension trace 160 is that part of shielding inter-connecting trace 156 below main inter-connecting trace 158, and in a via hole through second sheet 204. Upper inter-connecting extension trace 162 is that part of shielding inter-connecting trace 156 above main inter-connecting trace 158, and in a via hole through thirteenth sheet 226. Main inter-connecting trace 158 connects electrically all shielding-edge traces at a single point in each of them.

A shielding-strip trace set 170 is shown in FIG. 6B. It comprises shielding-strip traces and a shielding-element lead trace.

A lower shielding-strip trace 172 is laid on the top surface of first ceramic sheet 202, and an upper shielding-strip trace 174 is laid on the top surface of thirteenth ceramic sheet 226. Lower shielding-strip trace 172 is connected electrically to lower inter-connecting extension trace 160, and upper shielding-strip trace 174 is connected electrically to upper inter-connecting extension trace 162. A shielding-element lead trace 176 is connected to upper shielding-strip 174. Each shielding-strip trace has slits that nearly, but not completely, quarter it, and is a contiguous electrically-conducting element.

Shielding element 24 is shown in FIG. 6C. It comprises shielding-edge trace set 150 and shielding-strip trace set 170.

Figure 7A:
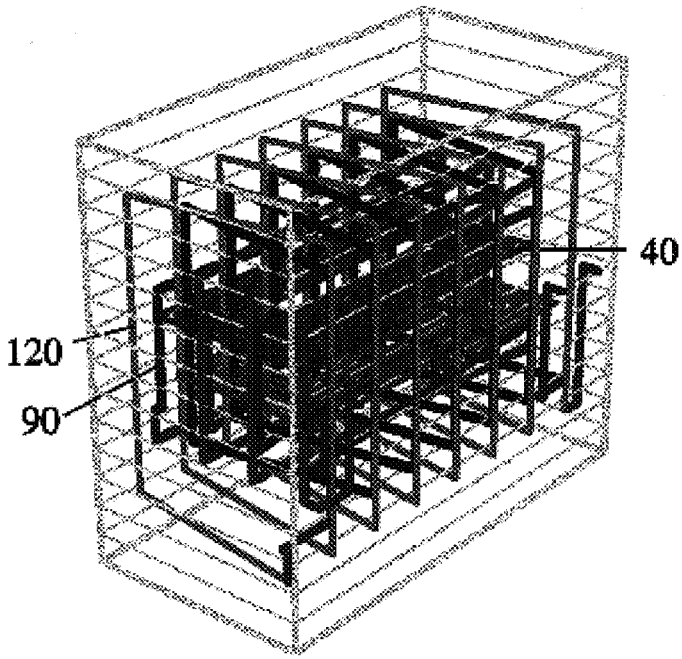
FIG. 7A shows the manner in which z-spiral, x-helix, and y-helix coupling elements are combined.

Coupling Elements Combined—FIG. 7A

Coupling element set 22 is shown in FIG. 7A. It comprises z-spiral coupling element 40, x-helix coupling element 90, and y-helix coupling element 120, each element nesting inside the volume enclosed by the next. Each of these coupling elements is configured either to sandwich, or surround, a volume in space that is approximately centered at the center of the ceramic body. A magnetic pick-up coil of this embodiment measures therefore magnetic field in three orthogonal directions substantially at a single point.

Figure 7B:
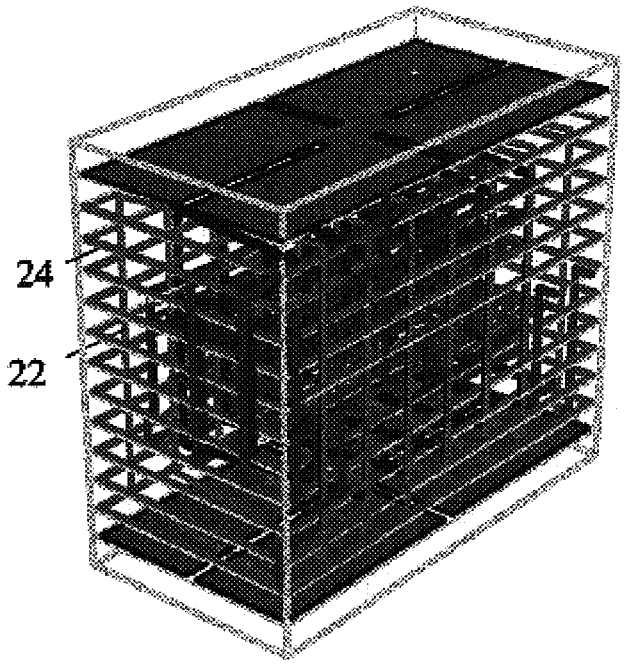
FIG. 7B shows the manner in which z-spiral, x-helix, and y-helix coupling elements, and electrostatic shielding element are combined.

Coupling and Shielding Elements Combined—FIG. 7B

Coupling element set 22 and shielding element 24 are shown combined in FIG. 7B. The combination represents interior elements of this preferred embodiment, and comprises z-spiral coupling element 40, x-helix coupling element 90, y-helix coupling element 120, shielding element 24, each element nesting inside the volume enclosed by the next.

A magnetic pick-up coil in this embodiment comprises substantially ceramic material, refractory metals, gold plating, and terminal pin metals, which out-gas little, even at high temperatures. These substances have high tolerance to damages by nuclear and optical radiation, and chemical reactions.

Additional Embodiments

Other embodiments of a magnetic field pick-up coil of the present invention are possible.

For example, an embodiment omits a shielding element. Its interior elements appear in FIG. 7A.

Another embodiment omits terminal pins, which require metal joining, for example, by brazing, and utilizes instead metallized pads for direct connection to external devices. Gold plating is omitted from the metallized pads in extremely high-temperature applications. This embodiment is not shown in a separate drawing, but should be easily understandable from inspection of FIG. 2A where terminal pins are to be omitted altogether, and metallized pads are bare and without gold plating.

Practical Magnetic Pick-up Coils

The model device used in this description for explaining salient structural features of the present invention will be a functioning tri-axial magnetic pick-up coil having most of advantageous characteristics of a practical device with a notable exception of specific sensitivity. A practical magnetic pick-up coil of the present invention usually incorporates coupling elements with many pairs of spirals and helixes, each with a much finer winding pitch, leading to far greater winding packing ratio and higher specific sensitivity than suggested by the model device. A practical device is built from a much greater number of ceramic sheets. But a practical device is sometimes built intentionally with fewer winding turns to meet some specific requirements, for example, good frequency response to rapidly changing magnetic field. Adding a shielding element is equivalent to an extra helical trace for the coil's physical size. Only a single shielding element needs to enclose coupling elements, no matter how many pairs of helixes or spirals they may have in a practical device. An electrostatic shield therefore adds minimally to the overall physical size of a coil of the present invention.

Advantages

From the description above, a number of advantages of a magnetic pick-up coil the present invention become evident:

1 The coil can be used in a wide variety of environments, ranging from a normal environment to hostile environments, allowing economically advantageous use of a minimal set of designs to serve in a wide variety of applications;

2 The coil, when provided with bare metallized pads but not brazed terminal pins, can be used up to temperatures just below co-firing temperatures, which can be over 1500° C.;

3 The coil, when provided with metallized pads and brazed terminal pins, can be used up to temperatures just below melting temperatures of braze material used, which are in excess of 900° C. for some silver-based braze material, and higher for some gold-based braze material;

4 The coil can be used in an ultra-high-vacuum environment;

5 The coil can be used in a nuclear- and optical-radiation environment;

6 The coil can be used in simultaneously present ultra-high-vacuum, high-temperature, and nuclear- and optical-radiation environments;

7 The coil can be used in a chemically reactive environment;

8 The coil can be used in a space-limited environment;

9 The coil can have specific sensitivity orders of magnitude greater than coils of a conventional construction that are suitable for use in hostile environments;

10 The coil can take advantage of multi-layer space curves in three dimensions for its coupling and shielding elements;

11 The coil can measure magnetic field in multiple directions substantially about a single point in space;

12 The coil can be built in a compact and rugged package;

13 The coil can be manufactured using the thick-film technology, which is ideally suited for mass production.

14 The coil can be manufactured economically by taking advantage of the economy of scale in mass production; and 15 The coil can be manufactured with uniform characteristics through mass production, with attendant reduction in the need and cost for individual testing and calibration.

Operation

A magnetic pick-up coil of the present invention, which is a passive device without any electrically energized components or moving parts, is placed in ambient magnetic field. The device produces voltage between a pair of terminal pins for each coupling element, according to the Faraday's law of induction when the ambient magnetic field varies with time.

An external device connected to the terminal pins, such as an electronic integrator or an amplifier, detects the voltage. A shielding element, when electrically grounded, reduces interference from signal sources that are electrostatic, rather than magnetic, in nature.

Conclusion, Ramifications, and Scope

Accordingly, the reader will see that the magnetic pick-up coil of the present invention can be used under a wide variety of conditions, including a normal environment as well as a hostile environment. This will allow the use of magnetic pick-up coils of only a minimal set of models in many different applications, and avoid the cost for designing, tooling, manufacturing, stocking, and marketing of a multitude of models.

The magnetic pick-up coil of the present invention solves problems in many scientific applications that cannot be surmounted with the coil of a conventional construction. These problems arise from needs for measuring magnetic field with high specific sensitivity in hostile environments, such as ultra-high-vacuum, high-temperature, intense nuclear- and optical-radiation, and limited-space environments, encountered either individually or in combinations.

The magnetic pick-up coil of the present invention is a rugged device made entirely of non-organic substances, which is suitable for use in manufacturing, testing, and other industrial settings. It solves problems associated with conditions that degrade or destroy material used for structural support and electrical insulation in coils of a conventional construction, for example, high-temperature, chemically reactive, nuclear-radiation, and ultra-violet-radiation environments. It is suitable for use in applications involving physically demanding conditions such as tight space and severe vibrations.

The magnetic pick-up coil of the present invention has coupling elements, which can measure magnetic field in multiple directions as well as in different frequency ranges, and an electrostatic shield for reducing interference from noise, all in a compact package.

The magnetic pick-up coil of the present invention can be manufactured with a well-established mass production technology, which results in the economy of scale in manufacturing as well as uniform device characteristics that reduce the need and cost for individual testing and calibration.

Although the description above contains many specifications, these should not be construed as limiting the scope of the invention but as merely providing illustrations of some of the presently preferred embodiments of this invention.

For example, elements of a magnetic pick-up coil of the present invention may be incorporated within a single monolithic ceramic body, together with elements of other devices. A ceramic body of a magnetic pick-up coil of the present invention may have a different shape, be topologically complex, having, for example, holes through it, or be much smaller or greater in size. Any number of coupling elements may be constructed in a single device. Coupling elements may have a geometrical shape suitable for coupling to magnetic field, but not the helix or spiral, have different characteristics, for example, frequency response, be disposed at angles other than orthogonal angles from each other, or be exposed partially on exterior surfaces of a ceramic body. A shielding element may have different patterns, be constructed in more than one segment, or exposed wholly or partially on exterior surfaces of a ceramic body. Connecting means may be placed on different surfaces of a ceramic body.

Thus the scope of the invention should be determined by the appended claims and their legal equivalents, rather than by the embodiments given.

I claim:

1. A magnetic field sensing device, capable of sensing magnetic fields, comprising:

one or more z-spiral coupling elements, each of said z-spiral coupling elements including a lower and an upper metallized z-spiral trace situated substantially equidistant from the mid-plane of said magnetic field sensing device and wherein the inner ends of said z-spirals are conductingly connected and wherein said z-spirals are wound in the same sense so that voltage generated in said upper z-spiral trace adds cooperatively to voltage generated in said lower z-spiral trace and vice-versa, and wherein said z-spirals are encapsulated in a substantially monolithic ceramic body.

2. The magnetic field sensing device of claim 1 further comprising:

an electrostatic shielding cage, said cage enclosing all of said coupling elements and being encapsulated in said substantially monolithic ceramic body.

3. A magnetic field sensing device, capable of sensing magnetic fields, comprising:

one or more x-helix coupling elements, each including an inner and an outer electrically conducting metallized x-helical trace, wherein the axis of said x-helical traces lie substantially on said mid-plane of said magnetic field sensing device and wherein said x-helical traces are conductingly connected at one end and are wound in the same sense so that voltage generated in said inner x-helical trace adds cooperatively to voltage generated in said outer x-helical trace and vice versa, and wherein said x-helix coupling elements are encapsulated in said substantially monolithic ceramic body.

4. The magnetic field sensing device of claim 3 further comprising:

an electrostatic shielding cage, said cage enclosing all of said coupling elements and being encapsulated in said substantially monolithic ceramic body.

5. A magnetic field sensing device, capable of sensing magnetic fields in two orthogonal directions, comprising:

one or more z-spiral coupling elements, each including a lower and an upper metallized z-spiral trace situated substantially equidistant from the mid-plane of said magnetic field sensing device and wherein the inner ends of said z-spiral traces are conductingly connected and wherein said z-spiral traces are wound in the same sense so that voltage generated in said upper z-spiral trace adds cooperatively to voltage generated in said lower z-spiral trace and vice-versa, and wherein said z-spiral coupling elements are encapsulated in a substantially monolithic ceramic body; and, one or more x-helix coupling elements, each including an inner and an outer electrically conducting metallized x-helical trace, wherein the axis of said x-helical traces are substantially orthogonal to the normal to said z-spiral traces and lie substantially on said mid-plane of said magnetic field sensing device and wherein said x-helical traces are conductingly connected at one end and are wound in the same sense so that voltage generated in said inner x-helical trace adds cooperatively to voltage generated in said outer x-helical trace and vice versa, and wherein said x-helix coupling elements are encapsulated in said substantially monolithic ceramic body.

6. A magnetic field sensing device, capable of sensing magnetic fields in three orthogonal directions, comprising:

one or more z-spiral coupling elements, each including a lower and an upper metallized z-spiral trace situated substantially equidistant from the mid-plane of said magnetic field sensing device and wherein said z-spiral traces are conductingly connected at their inner ends and are wound in the same sense so that voltage generated in said upper z-spiral trace adds cooperatively to voltage generated in said lower z-spiral trace and vice-versa, and wherein said z-spiral coupling elements are encapsulated in a substantially monolithic ceramic body;

one or more x-helix coupling elements, each including an inner and an outer electrically conducting metallized x-helical trace, wherein the axis of said x-helical traces are substantially orthogonal to the normal to said z-spiral traces and lie substantially on said mid-plane of said magnetic field sensing device and wherein said x-helical traces are conductingly connected at one end and are wound in the same sense so that voltage generated in said inner x-helical trace adds cooperatively to voltage generated in said outer x-helical trace and vice versa, and wherein said x-helix coupling elements are encapsulated in said substantially monolithic ceramic body;

one or more y-helix coupling elements, each including an inner and an outer electrically conducting metallized y-helical trace, wherein the axis of said y-helical traces are substantially orthogonal to both said normal to said z-spiral traces and said axis of said x-helical traces and lie substantially on said mid-plane of said magnetic field sensing device and wherein said y-helical traces are conductingly connected at one end and are wound in the same sense so that voltage generated in said inner y-helical trace adds cooperatively to voltage generated in said outer y-helical trace and vice versa, and wherein said y-helix coupling elements are encapsulated in said substantially monolithic ceramic body; and, an electrostatic shielding cage, said cage enclosing all of said coupling elements and being encapsulated in said substantially monolithic ceramic body.

* * * * *